US006135320A

United States Patent [19]

Parsons

[11] Patent Number: 6,135,320

[45] Date of Patent: Oct. 24, 2000

[54] SPRING-LOADED AUTOMATIC FLUID-DISPENSING SYSTEM

[75] Inventor: Natan E. Parsons, Brookline, Mass.

[73] Assignee: Arichell Technologies, Inc., West Newton, Mass.

[21] Appl. No.: 09/220,620

[22] Filed: Dec. 24, 1998

[51] Int. Cl.[7] ..... B67D 5/08

[52] U.S. Cl. ..... 222/63; 222/214

[58] Field of Search ..... 222/63, 181.3, 222/183, 207, 209, 212, 214

[56] References Cited

U.S. PATENT DOCUMENTS

| | | | |
|---|---|---|---|
| 3,639,920 | 2/1972 | Griffin et al. | 4/166 |
| 3,712,512 | 1/1973 | Snider, Jr. et al. | 222/67 |
| 3,871,554 | 3/1975 | Huck | 222/96 |
| 4,136,802 | 1/1979 | Mascia et al. | 222/95 |
| 4,557,728 | 12/1985 | Sealfon et al. | 604/134 |
| 4,722,372 | 2/1988 | Hoffman et al. | 141/98 |
| 4,781,689 | 11/1988 | Sealfon et al. | 604/134 |
| 4,946,070 | 8/1990 | Albert et al. | 222/52 |
| 4,946,072 | 8/1990 | Albert et al. | 222/105 |
| 4,991,742 | 2/1991 | Chang | 222/95 |
| 5,186,360 | 2/1993 | Mease et al. | 222/63 |
| 5,186,563 | 2/1993 | Gebhard et al. | 222/214 |
| 5,255,822 | 10/1993 | Mease et al. | 222/63 |
| 5,323,932 | 6/1994 | Bauman | 222/96 |
| 5,356,051 | 10/1994 | Azuma et al. | 222/396 |
| 5,398,845 | 3/1995 | Meyer | 222/1 |
| 5,556,005 | 9/1996 | Banks | 222/96 |
| 5,625,908 | 5/1997 | Shaw | 4/623 |

*Primary Examiner*—Philippe Derakshani
*Attorney, Agent, or Firm*—Cesari & McKenna, LLP

[57] ABSTRACT

An automatic soap dispenser (10) includes a bellows-type collapsible container (18) of liquid soap. Constant-force springs (40 and 42) compress the container so as to expel the soap through a spout (16) when a valve-containing dispensing mechanism (20) permits it. When a sensor (14) detects an object such as a user's hand, a control circuit (56) operates the dispensing mechanism to permit soap flow through the spout for a predetermined time interval. Because of the constant-force springs, there is no need to use electric power to eject the liquid soap despite its typically high viscosity.

12 Claims, 3 Drawing Sheets

SPRING-LOADED AUTOMATIC FLUID-DISPENSING SYSTEM

BACKGROUND OF THE INVENTION

The present invention is directed to automatic liquid dispensing. It principally, but not exclusively, concerns dispensing of viscous materials such as liquid soap.

The conservation and sanitary advantages of automatic flow control in sink and similar installations is well known, and a large percentage of public rest-room facilities have provided automatic faucets and flushers as a result. There is a similar advantage to making liquid-soap dispensing automatic in such installations, but the popularity of doing so has not been great so far.

A significant part of the reason for this is installation difficulty. Installing the liquid-soap dispenser often requires providing extra wiring. A solution to this problem, which is to employ battery-operated systems as is now popular for retrofitting manual faucets to make them automatic, has heretofore involved problems of its own. In particular, the power required to pump liquid soap, which can be fairly viscous, is significant, so battery life would ordinarily be too short to be practical unless the batteries are excessively large.

SUMMARY OF THE INVENTION

I have recognized that this difficulty can largely be overcome simply by using an approach employed by some other types of dispensing arrangements. Specifically, I use a spring to pre-load the container so that the spring provides the power that expels the (typically viscous) liquid. Then electrical power is needed only for automatic sensing and operating a flow-controlling valve in response. In accordance with my invention, moreover, the spring employed is of the constant-force type so that there is little pressure difference—and thus little difference in the force with which the liquid is expelled—between the liquid container's full and empty states.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
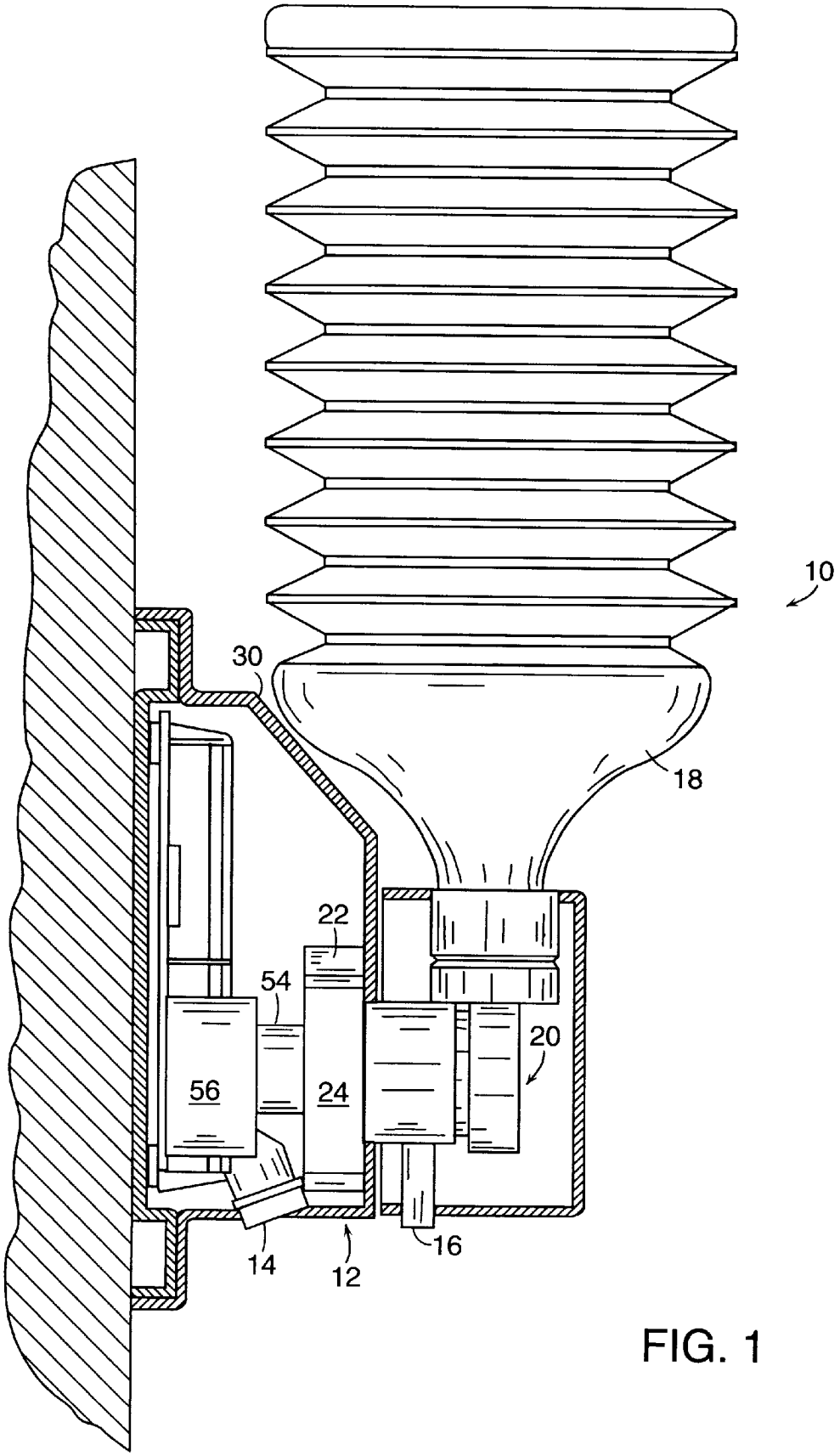
FIG. 1 is a side sectional view, with parts removed, of a wall-mounted soap-dispenser, including a disposable soap container.

In FIG. 1, an automatic soap dispenser 10 includes a wall-mounted sensor-and-control assembly 12 including an object sensor 14 for detecting an object such as a user's hand under a spout 16 from which soap is to issue. In some embodiments the object sensors will simply respond whenever an object is present. In others the sensor will impose some criteria, such as object motion, that will tend to exclude unintended types of targets. Also, although other kinds may be employed, the sensor will most often be of the infrared or ultrasonic variety.

Ultrasonic varieties detect objects by transmitting ultrasound into the target region and sensing any resultant echo. Of the infrared varieties, some, "active" varieties shine infrared radiation into a target region and base their presence determinations on resultant reflections. Other, "passive" infrared systems do not shine radiation into the target region. They base their determinations on radiation that objects emit or reflect naturally.

The spout 16 is part of a disposable soap-supply unit that includes a reservoir-forming container 18 together with a dispensing mechanism 20. For reasons that will be explained in due course, the container 18 is of the collapsible, bellows type.

Figure 2:
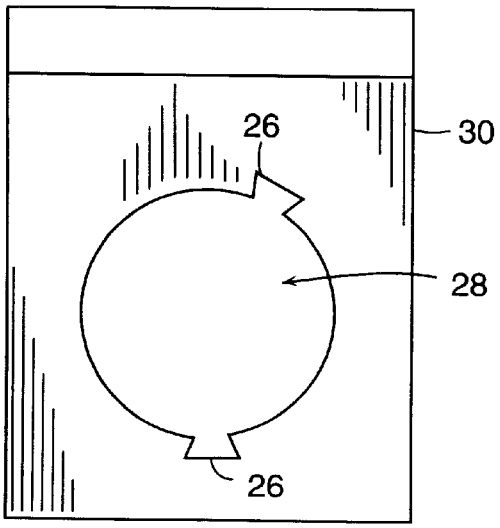
FIG. 2 is a front elevation of the housing of the soap dispenser's sensor-and-control assembly.
Figure 3:
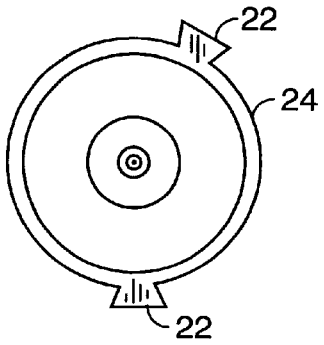
FIG. 3 is a front elevation of the dispensing mechanism's locking collar.

To mount the soap-supply unit in the sensor-and-control assembly 12, the installer holds the container 18 with its longitudinal axis at an angle to the vertical so that, as FIGS. 2 and 3 illustrate, tabs 22 on the dispensing mechanism's locking collar 24 are aligned with mating recesses 26 that extend from the opening 28 in the front wall of a sensor-system housing 30. The installer then locks the container in place by rotating it so that the tab and recesses are no longer aligned.

Figure 5:
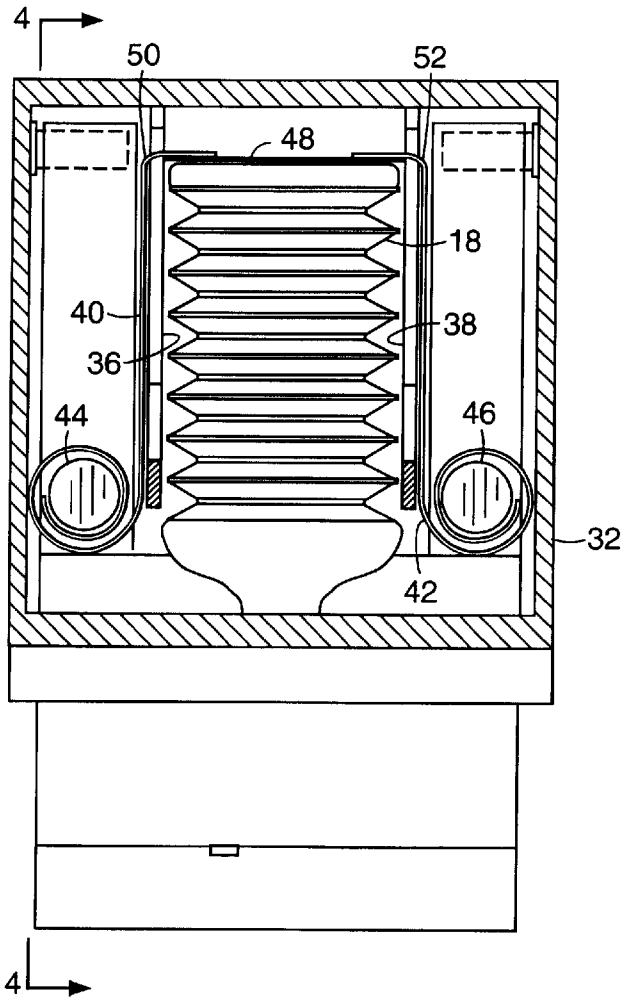
FIG. 5 is a side elevation of the FIG. 4 embodiment.
Figure 4:
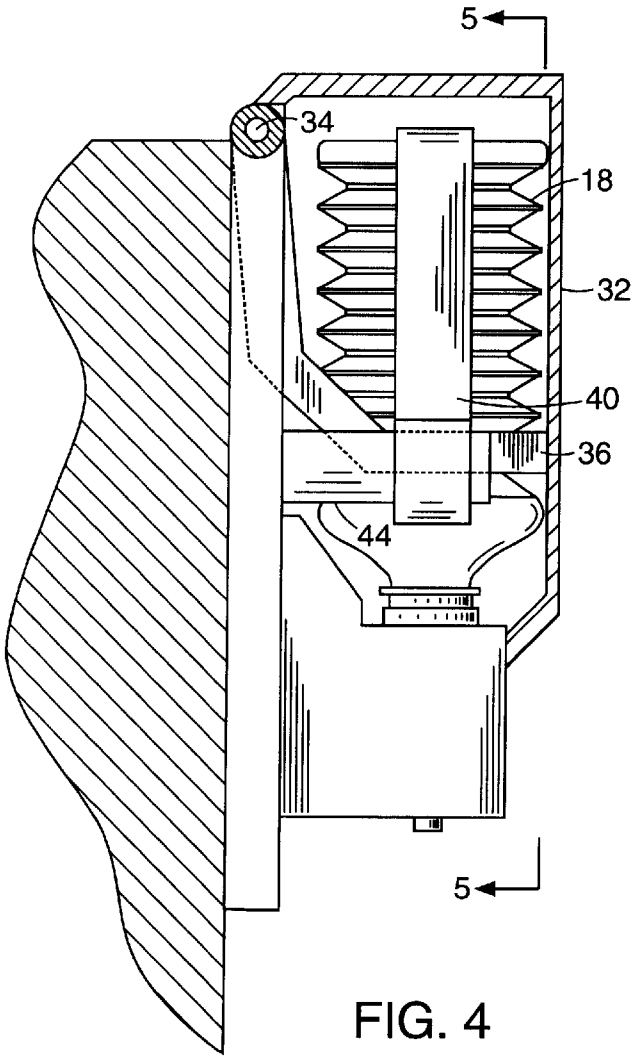
FIG. 4 is a side elevation of the soap dispenser, complete with its cover and constant-force springs.

With the container thus locked in place, the installer closes a cover not shown in FIG. 1. FIGS. 4 and 5 show the cover 32's closed position. The cover 32 is pivotably mounted by hinges 34 and includes spring-retraction arms 36 and 38. Those arms are disposed on opposite sides of the container 18 between it and two constant-force springs 40 and 42 wrapped about wall-mounted dowels 44 and 46 and joined by a connection plate 48. In accordance with the present invention, these springs thereby exert on the container 18 a force that tends to collapse it. Before the cover 32 is closed, the arms 36 and 38 engage the springs 40 and 42 under shoulder portions 50 and 52 and hold them and the connector plate 48 out of contact with the container so that the container can be replaced.

The force that the springs exert pressurizes the container's liquid contents so as to provide the pressure needed to force the typically viscous liquid through the spout. Ordinarily, FIG. 1's spring-loaded solenoid 54 holds a valve (not shown) in the dispensing mechanism 20 closed and prevents the thus-pressurized liquid from traveling to the spout. When the sensor 14 detects an object (such a user's hand) meeting appropriate criteria, though, a control circuit 56 operates the solenoid 54 to a retracted position, in which it allows the valve to open for a predetermined interval. Preferably, the solenoid 56 is of the latching variety, which requires no power to remain in the retracted or extended states but only to toggle between them. Such a valve requires only a short current pulse at the beginning of the valve-open interval to open the valve and another short current pulse at the end of that interval to close it again.

Actually, the force applied by these "constant-force" springs varies by a small amount as the container collapses. So long as the spring force varies by less than about 20% between the bellows-type container's expanded and compressed positions, though, the variation is largely imperceptible, and no compensation for it is necessary.

The energy required to expel liquid during this valve-open interval comes exclusively from the spring; no electrical energy is needed for that purpose. So the system can be battery powered, making its installation practical in many situations in which it previously was not. The invention thus constitutes a significant advance in the art.

What is claimed is:

1. A liquid dispenser comprising:

A) a container forming a reservoir that contains a fluid, being collapsible between expanded state, in which the reservoir has a first volume, and a contracted state, in which the reservoir has a second volume less than half the first volume;

B) at least one flow controller, each of which comprises:

i) a conduit that so communicates with the interior of the reservoir that the container tends to expel the liquid through the conduit when the container collapses from its expanded to its contracted;

ii) an electric valve operable by application of control signals thereto to switch between an open state, in which the valve permits fluid flow through the conduit, and a closed state, in which it prevents fluid flow through the conduit; and iii) a sensor circuit operable to sense the presence of objects in a target region and apply control signals to the electric valve control flow of liquid through the conduit in response to at least one predetermined characteristic of the sensed object; and C) a spring that so bears against the container as to urge it toward its contracted state with a force that varies by less than 20% between the expanded and contracted states and causes a reservoir pressure that exceeds ambient by more than 10 psi.

2. A liquid dispenser as defined in claim 1 wherein the sensor circuit responds to at least one said predetermined characteristic of the sensed object by so applying the control signals to the electric valve as to cause it to permit flow through the conduit for a predetermined time duration and stop flow at the end of the predetermined duration.

3. A fluid-dispensing system as defined in claim 2 wherein the liquid consists essentially of liquid soap.

4. A fluid-dispensing system as defined in claim 2 wherein the sensor circuit includes an ultrasonic object detector.

5. A fluid-dispensing system as defined in claim 2 wherein the sensor circuit includes an infrared object detector.

6. A fluid-dispensing system as defined in claim 5 wherein the infrared object detector is an active infrared object detector.

7. A fluid-dispensing system as defined in claim 5 wherein the infrared object detector is a passive infrared object detector.

8. A fluid-dispensing system as defined in claim 1 wherein the liquid consists essentially of liquid soap.

9. A fluid-dispensing system as defined in claim 8 wherein the sensor circuit includes an ultrasonic object detector.

10. A fluid-dispensing system as defined in claim 8 wherein the sensor circuit includes an infrared object detector.

11. A fluid-dispensing system as defined in claim 10 wherein the infrared object detector is an active infrared object detector.

12. A fluid-dispensing system as defined in claim 10 wherein the infrared object detector is a passive infrared object detector.

* * * * *